US005947162A

United States Patent [19]

Steiner et al.

[11] Patent Number: 5,947,162

[45] Date of Patent: Sep. 7, 1999

[54] SERIES SHED WEAVING MACHINE WITH A WEAVING ROTOR

[75] Inventors: Alois Steiner, Rieden; Peter Grimm, Rüti; Antonio Diaz, Gossau, all of Switzerland

[73] Assignee: Sulzer Rueti AG, Rueti, Switzerland

[21] Appl. No.: 08/973,412

[22] PCT Filed: Apr. 26, 1996

[86] PCT No.: PCT/CH96/00155

§ 371 Date: Dec. 2, 1997

§ 102(e) Date: Dec. 2, 1997

[87] PCT Pub. No.: WO96/38610

PCT Pub. Date: Dec. 5, 1996

[30] Foreign Application Priority Data

Jun. 2, 1995 [CH] Switzerland ..... 1633/95

[51] Int. Cl.[6] ..... D03D 41/00; D03J 1/00

[52] U.S. Cl. ..... 139/28; 139/1 C

[58] Field of Search ..... 139/28, 1 C

[56] References Cited

U.S. PATENT DOCUMENTS

| | | | |
|---|---|---|---|
| 3,311,135 | 3/1967 | Maguire . | |
| 3,921,675 | 11/1975 | Filter . | |
| 4,291,729 | 9/1981 | Steiner | 139/28 |
| 4,592,393 | 6/1986 | Steiner | 139/11 |
| 5,738,150 | 4/1998 | Roelstraete | 139/1 C |

FOREIGN PATENT DOCUMENTS

| | | |
|---|---|---|
| 0 012 253 A1 | 6/1980 | European Pat. Off. . |
| 2 027 876 A1 | 2/1980 | United Kingdom . |

*Primary Examiner*—Andy Falik
*Attorney, Agent, or Firm*—Townsend and Townsend and Crew LLP

[57] ABSTRACT

A weaving rotor of a series shed weaving machine provides a cover which forms a ring channel with the weaving rotor from a laying-in station up to the cloth edge in the direction of rotation. The ring channel is closed off by further covers, in the direction of rotation and at the side face where the weft arrives. Suction nozzles are mounted along the cloth edge which are dimensioned in such a manner that in spite of the air entering from the insertion and relay nozzles they produce a depression and a flow from the laying-in station to the cloth edge which prevents the deposition of fly. An additional suction nozzle at the arrival of the weft, which is placed in the direction of the weft insertion, additionally stabilizes the flow conditions in the ring channel.

15 Claims, 4 Drawing Sheets

SERIES SHED WEAVING MACHINE WITH A WEAVING ROTOR

The invention relates to a series shed weaving machine with a weaving rotor which is equipped with insertion and beat-up combs and which combs through warp threads in the form of sheds from a laying-in station up to a cloth edge with the insertion combs at its periphery, while the weft threads are fed into the sheds from a weft thread preparation system, with the beat-up combs of the weaving rotor beating up the inserted weft threads at the edge of the cloth formed.

A series shed weaving machine with a weaving rotor is shown in the patent application EP-A-0 012 253.

DESCRIPTION OF THE PRIOR ART

The problem of fly, which collects at unsuitable places and of which as little as possible should be woven in, arises in series shed weaving machines as well as in weaving machines in general. Since the sheds in a series shed weaving machine are combed through in the form of intersecting warp threads, and since these warp threads are deflected under tension at the individual combs while the weft threads are being inserted, fly and heat arise in the insertion region between the laying-in station and the cloth edge.

For the example of a spinning machine, the patent application EP-A-0 580 028 discloses a tube-shaped work room for textile machines into which ambient air is blown that has been drawn from the installation room and conditioned at the machine in order to avoid a conditioning of the entire installation room and to convey the used air to the outside. The disadvantage of such an arrangement is that it can solve the problem of arising fly only to a limited extent, since the fly accumulates in all possible corners, crevices and dead air spaces.

Furthermore, it can not be imagined how a weaving machine, in which large quantities of air accumulate on insertion of the weft, can be encapsulated in this manner and how weaving in of the fly can be prevented.

SUMMARY OF THE INVENTION

The object of the invention is therefore to directly convey off the fly produced in a series shed weaving machine.

A further object of the invention is to convey off the heat produced in the series sheds.

This object is satisfied in that the weaving rotor is covered over by a cover forming a ring channel in the region of the combs from the laying-in station up to immediately ahead of the cloth edge in the direction of rotation, and in that suction nozzles are placed along the cloth edge which suck out from the ring channel the introduced air along with the arising fly.

The advantage of this arrangement is that a low pressure area and a strong air flow in the direction of rotation are produced in the ring channel thus formed, wherein the flow is augmented by the movement of the comb rows in the direction of rotation. Fly which originates on combing through the sheds is brought into the ring channel by the impulses from the insertion nozzles and wandering fields, by the suction effect in the ring channel as well as by the slight outward centrifuging action in the rotational flow, with the impacts on beating up of the weft threads acting to reduce friction at the points of contact with the fly. Further advantageous developments of the invention are specified in the dependent claims. Since an average clearance in the ring channel of less than 25 mm is maintained between the cover and the highest comb tips, a still tolerable suction power of the suction nozzles suffices to produce the required flow in the ring channel. In addition, due to the high velocities, size carried along by the air can deposit only to the extent of a low and harmless film thickness.

In order not to hinder the insertion of the weft thread and to maintain low pressures in the region of arrival of the weft thread, the constitution of the nozzle cross-section of the suction nozzles per unit length increases in the weft insertion direction. In order to capture the fly at the weft arrival side without congestion, the ring channel is extended outside the combs as a ring-shaped channel with a side wall sealed against the weaving rotor. An additional suction nozzle which simultaneously stretches the weft thread tip is mounted at the side face in the region of arrival of the weft thread. This has the advantage that the suction flow and the fly execute a screw-like motion, whereas the insertion side can remain open at the ring channel. In contrast, the elements in the ring channel at the arrival of the weft, which are not shown here, such as the weft monitor and cutting and stretching devices, are advantageously encased so that they are streamlined in the direction of rotation and no accumulation of fly can build up.

Since it is difficult to accommodate large suction cross-sections in the region of the cloth edge due to space considerations, it has proved advantageous to place the suction nozzles and a suction tube common to them in the cover and to bring the cover from an open position into a working position with a guided movement. It is advantageous here to move the cover in the form of a movable cover out of the way to an extent that not only the insertion region at the weaving rotor is accessible, but also other functional members in the region of the cloth edge, such as the temple and any weft thread monitors and weft break menders that may be present are accessible and removable as well. The same holds for members in the ring-shaped channel at the arrival of the weft such as e.g. for a cutting and stretching device.

It is also worthwhile to place a cover with low clearance to the comb tips at those peripheral parts of the weaving rotor which contain no sheds, since in this manner the rotary movement of the combs already prevents an accumulation of fly. An apron which can brush or rub slightly in the direction of rotation not only reduces the clearance to a minimum but also acts as a long term lubrication for the comb tips if it is executed of Teflon for example. Due to the fact that the fly-producing regions are under reduced pressure and an air flow is continuously sucked out of this low pressure region by a suction fan, a large proportion of the fly can be captured and eliminated via a filter in the air stream.

In the ring space itself, compressed air is continuously being introduced by the quasi stationary insertion nozzles and by the quasi stationary wandering fields so that it at first appears senseless to make this space small due to the mutual influence. However, for a good elimination of fly, it has proved necessary to keep the distance between the highest comb tips and the cover of the ring channel less than 25 mm and to keep the suction power high so that sufficient air velocities arise in the direction of the suction. An additional suction nozzle placed at the arrival of the weft thread and in the direction of insertion helps to stabilize the flow conditions.

Since the air sucked off also carries frictional heat from the weaving rotor with it, it is worthwhile to convey the air after the suction fan together with the cooling air of the drives along a common ventilation channel and out of the installation room. It can likewise be advantageous to condition the warp threads with an air-conditioning channel at the machine prior to laying them in.

DESCRIPTION OF THE PREFERRED EXEMPLARY EMBODIMENTS

The examples show a cover for the weaving rotor of a series shed weaving machine, which cover forms a ring channel with the weaving rotor from a laying-in station up to the cloth edge in the direction of rotation. The ring channel is closed off in the direction of rotation and at the side face at the arrival of the weft by further covers. Suction nozzles are mounted along the cloth edge and are dimensioned such that in spite of the air infeed from the insertion and relay nozzles they produce a depression and a flow from the laying-in station to the cloth edge, which prevents the deposition of fly. An additional suction nozzle arranged at the arrival of the weft thread and in the direction of insertion provides additional stabilization of the flow conditions in the ring channel.

Figure 1:
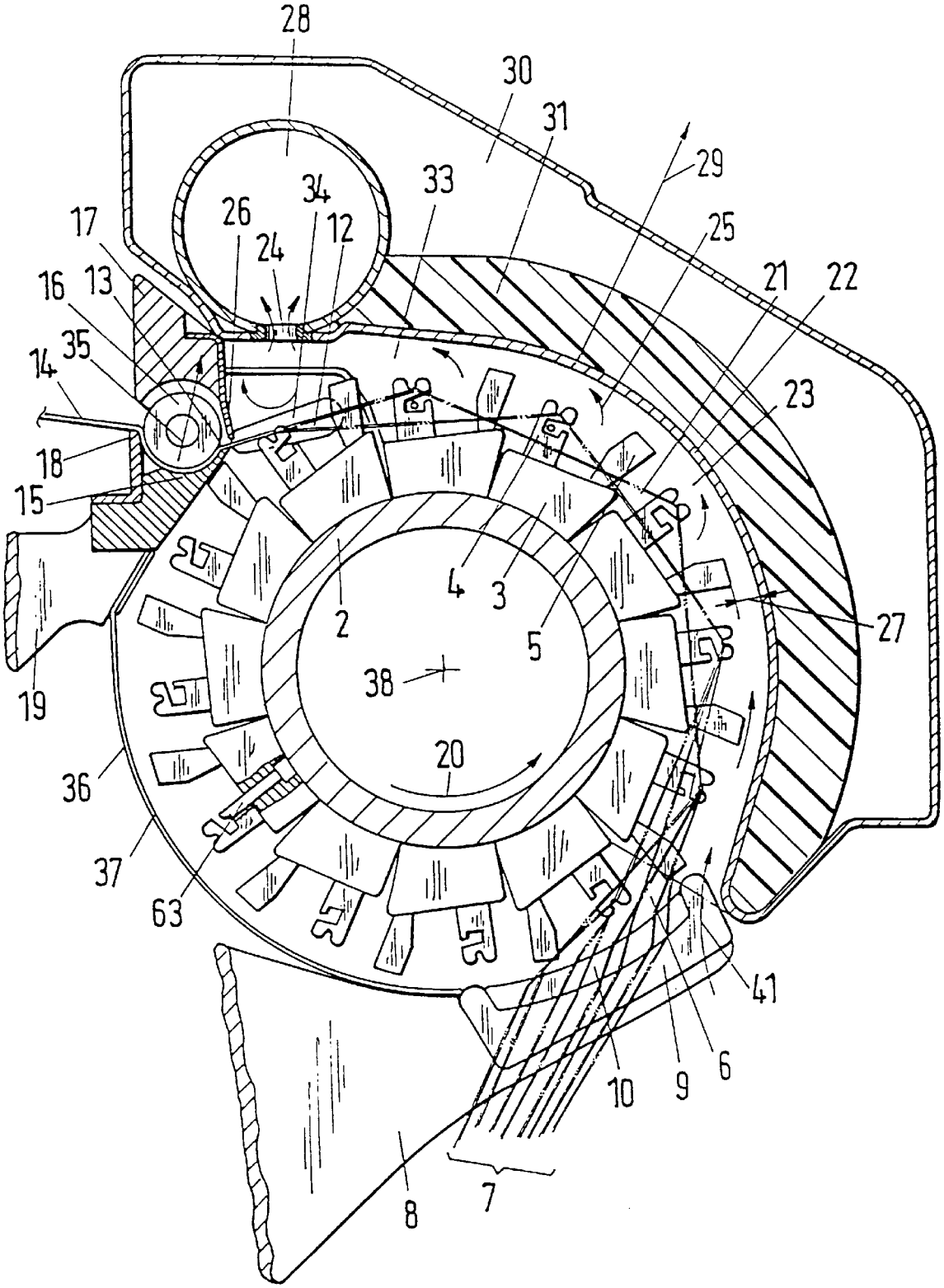
FIG. 1 shows a part of a section perpendicular to the axis of a weaving rotor in a series shed weaving machine, with a removable cover forming a ring channel together with the weaving rotor between the laying-in station and the cloth edge.

FIG. 1 shows the externally visible members of a weaving rotor 2 which is equipped with comb rows 3, each of which consists of an insertion comb 4 and a beat-up comb 5. The weaving rotor 2 rotates in the direction of rotation 20 about its axis 38 and it combs 4, 5 engage with the warp threads 7 at the laying-in station 6, which are distributed into the combs by means of a series of laying-in rails 10. The laying-in rails, oriented parallel to the combs, are guided at spacings by narrow guide members 9 lying between the warp threads 7. The guide members are themselves supported on the frame of the weaving machine via support arms 8. The combs 4, 5 comb through the warp threads skeds 2/1 from the insertion station 6 up to the beat-up edge 13. Weft threads 12 are simultaneously inserted, each of which reaches the weft thread arrival point at the other side of the rotor prior to being beaten up. In addition to the insertion nozzles, which are not shown, relay nozzles 63 produce wandering fields 51 (FIG. 4) at the rotating rotor, which, when viewed externally from the weaving rotor, are produced in a quasi-stationary manner.

The beat-up combs 5 push the weft threads 12 to the edge of the shed and beat them up against the cloth edge 13, with the already produced cloth 14 being fixed by a support beam 15 and a temple 16 which causes deflection under a bias force. The temple 16 is in turn braced against a longitudinal spar 17 which also carries a metal cover sheet 26, while the forces at the bracing beam 15 and at a deflection member 18 are transmitted by arms 19 leading to the machine housing. A ring channel 23 extending from the laying-in station 6 up to the cloth edge 13 is produced by a cover 22 together with the weaving rotor. The cover is executed as an independently removable cover 30, and the ring channel is closed off by the metal cover sheet 26 at the cloth edge 13 and at the side face 33 at the side at which the weft thread arrives.

In order to produce a flow in a prescribed suction direction 25 in the ring channel 23 (see also FIG. 4), suction nozzles 24 are placed in the cover 22 along the beat-up edge 13 and open into a suction tube 28. The suction nozzles 24 are dimensioned in such a manner that ambient air 41 also flows into the ring channel 23 at the laying-in station 6. It is worthwhile here to keep the distance 27 of the cover 22 from the highest comb tips small in order that the suction power can be made smaller. If, for instance, a sufficient flow in the suction direction 25 is produced for a given arrangement of the suction nozzles 24 at a distance 27 of 8 mm, then this is insufficient if the distance is doubled. A distance 27 of more than 25 mm over the length of the weaving rotor no longer permits a reliable removal of fly. This also shows, however, that corresponding attention must be paid to the relative position of the cover 22 with respect to the weaving rotor 2. For this reason the cover 30 is removable and repositionable to its working position with a guided movement 29, which can be performed e.g. with pivot arms 57 (see FIG. 3). Here, the cover 30 is so far removable that the spar 17 together with the temple 16 can also be moved away from the support beam 15 with a pivotal movement 35 in order to expose the cloth 14. The cover 30 also contains acoustic insulation 31 in order to damp the noise of the beating-up.

An additional suction nozzle 34 is mounted in the direction of insertion at the weft thread arrival point at the side face 33 and has a form distorted in the direction of rotation in order to capture the weft threads arriving with rotation with the wandering field 51, in order to convey the air pulses of the weft insertion out of the ring channel 23 without deflection and to stretch the tip of the weft thread with a bias tension for a clamping and trimming process which may take place.

Figure 2:
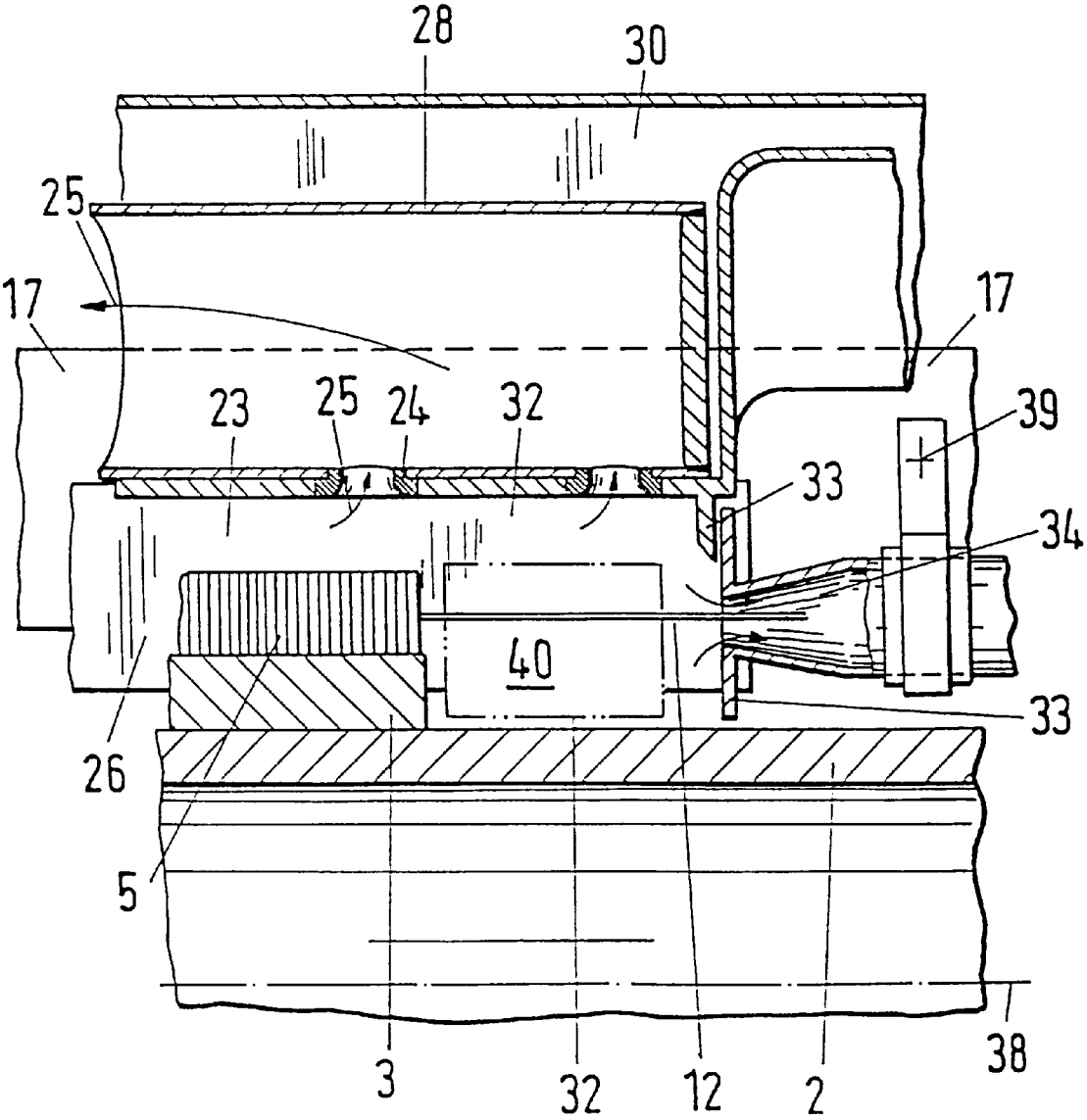
FIG. 2 shows a part of a longitudinal section of the weaving rotor in the region of the arrival of the weft thread.

In FIG. 2 the additional suction nozzle 34 is mounted behind a recess in the side face 33 connected to the cover 30 and has a collar by means of which the rest of the recess is covered off. The additional suction nozzle 34 is secured to the spar 17 by means of a clamp 39 independently of the cover 30. At the end of the comb row 3 the ring channel 23 is prolonged up to the side wall 33 by a ring-shaped channel 32, which is larger due to the absence of the comb row, in order to be able to mount additional devices such as, for example, a cutting and stretching device 40 and weft thread monitors, whose outlines are indicated. The suction nozzles 24 open directly into the suction tube 28. The suction tube 28 itself is closed by a base at the level of the side wall 33 and conducts off the air in the direction opposite that of the weft insertion. This allows space to be provided for further elements in the cover 30 behind the side wall 33 with no detriment to the removal of the fly.

In FIG. 1 a cover 36 adjoins the support beam 15 in the direction of rotation 20, and the cover 36 lies on the carrier arm 8 as an apron 37 and extends up to the laying-in rails 10. The movable part of the apron 37 consists of a 2 mm thick Teflon sheet which can brush against the comb tips in the presence of a corresponding depression at the inner side. The fly arising is largely encapsulated by this measure. No accumulations of fly can arise to disturb the insertion at the combs, and the fly can be largely removed with the suction flow. Thus, by way of example, after a million insertions in a series shed weaving machine, 400 grams of fly were found, more than 200 grams of which could be expelled and eliminated, whereas a comparable projectile weaving machine had more fly, which could not be removed.

Figure 4:
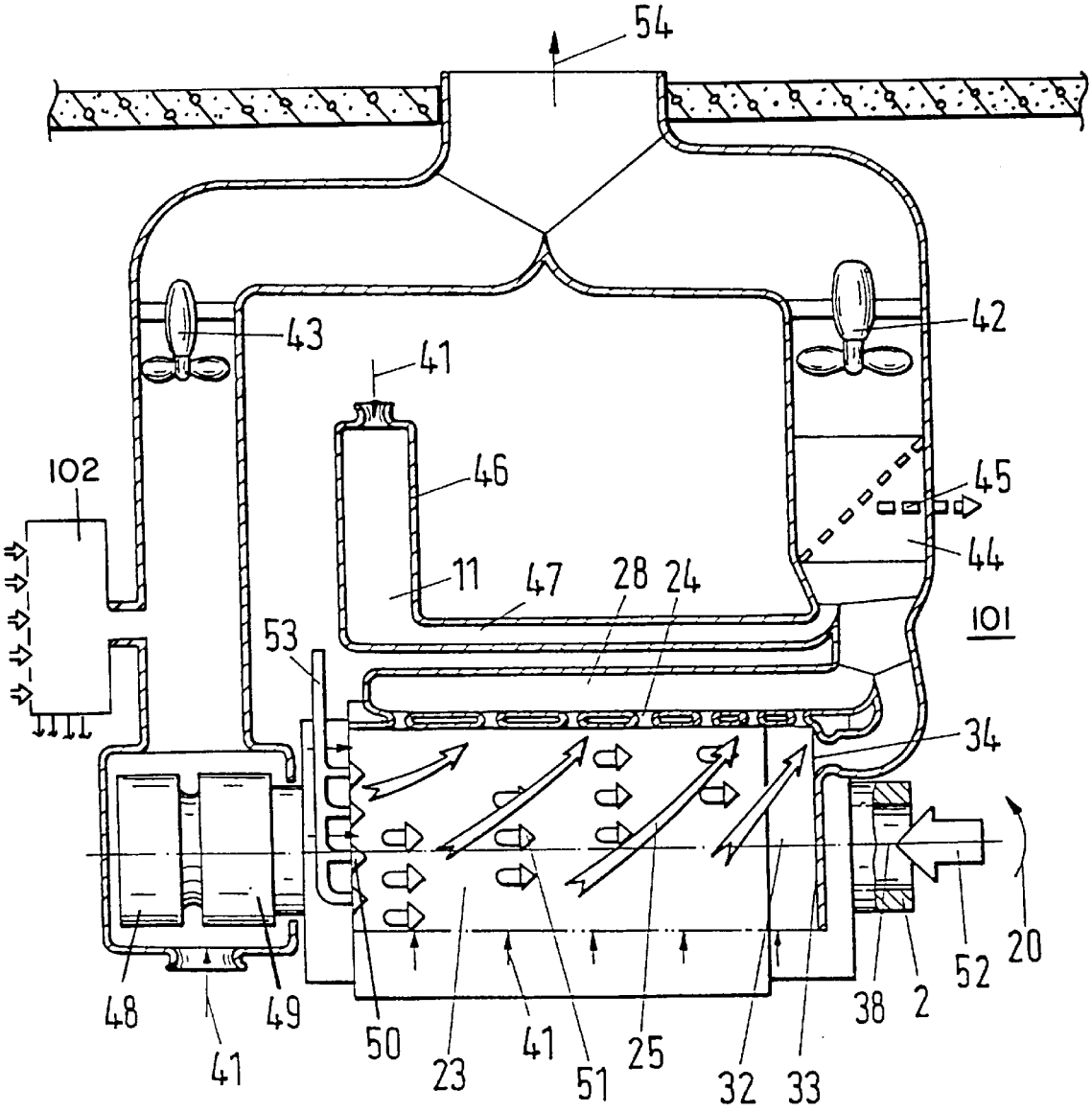
FIG. 4 is a cross-section view of a shed weaving machine schematically showing the air management of a series shed weaving machine with a weaving rotor which has a ring channel with suction nozzles.

The air management is schematically summarized in FIG. 4 partially in a developed view. The ring channel 23 and the ring-shaped channel 32 are indicated on the weaving rotor 2 in chain dotted lines. At the weaving rotor 2, which rotates in the direction of rotation 20, a compressed air infeed 52 for the relay nozzles is shown at the right side face, which nozzles produce wandering fields 51 along a screw line in the region of the ring channel 23 in the sheds, which are not shown here. A drive motor 48 and a transmission 49 are indicated at the left end face of the weaving rotor 2. Insertion nozzles 50, which rotate along with the weaving rotor 2, are supplied with compressed air 53 and with weft threads (not shown here) from a weft thread preparation system via a spatially fixed part. The ring channels 23, 32 are closed at the top except for the suction nozzles 24, which have increasingly closer spacing to one another in the direction of insertion in order to achieve an increasing suction cross-section. The right side wall 33 likewise closes off the ring-shaped channel 32, except for the additional suction nozzle 34. The suction power of the suction nozzles should be so great that no reverse flow occurs in the ring channel 23, but rather that air 41 is sucked in from the surroundings in order to produce a flow in the suction direction 25 along a screw line. Here, not only must the air blown in under pressure by the insertion nozzles 50 and the wandering fields 51 be removed, but also a part of the air moved along by the comb rows, which is partially held back by the warp threads at the cloth edge when the combs disengage—by way of example, at 2,800 insertions per minute, more than 46 comb rows enter into the ring channel 23 per second.

The fly is sucked off with the air from the suction tube 28 and from the additional suction nozzle 34 through a filter 44 by a suction fan 42. A weft thread conveying device 11 is encapsulated by a housing 46 in such a manner that external air 41 is sucked in through said weft thread conveying device by the same suction fan 42 with such a high velocity that the fly is likewise conveyed to the filter 44 via an input line 47. Fly removal 45 from the filter 44 is done at larger time intervals.

Since the air conveyed off by the suction fan 42 carries off a large portion of the frictional heat arising at the weaving rotor and is heated, it is worthwhile leading off the heat from the motor 48 and the transmission 49 as well with a further suction fan 43 by guiding sucked in external air 41 through a casing along the motor and transmission. A control system 102 can likewise be cooled by the suction fan 43. The two air flows are brought together into a tube as exhaust air 54 and can be conveyed, for example via an exhaust air conduit, to outside the installation room 101.

For an installed power of say 8 kilowatts in a series shed weaving machine, 1 kilowatt is used for example for the cloth beam drive and a warp let-off, whereas the heat produced by the remaining power, which comprises about 1.2 kilowatts for the suction blowers 42, 43 and perhaps around 5 kilowatts for the motor 48, for the weft thread preparation and for the control 102 including the insertion work, can largely be kept out of the atmosphere of the installation room 101.

Figure 3:
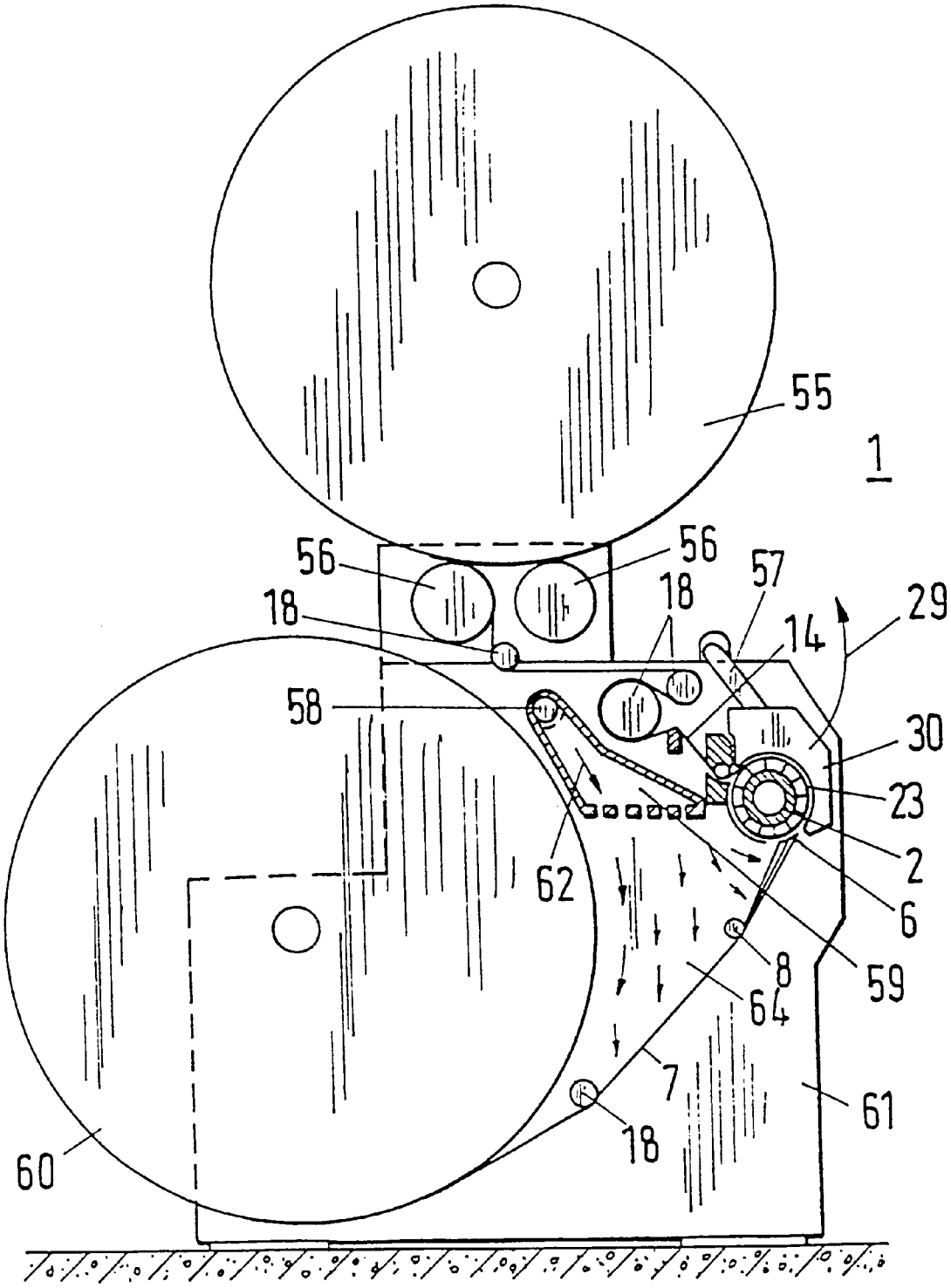
FIG. 3 shows a section through a series shed weaving machine perpendicular to the axis of the weaving rotor in which the paths of the warp threads and the cloth can be seen.

FIG. 3 shows the path of the warp threads 7, which are led from a warp beam 60 over deflecting members 18 to the laying-in station 6 and through the ring channel 23 about the weaving rotor 2 to the cloth edge. They leave this cloth edge as cloth 14, which is drawn up onto a cloth beam 55 via further deflection members 18 and a drive roller 56. Conditioned air 62 is brought into an air-conditioning channel 59 via a supply line 58 and slowed down in velocity. The conditioned air enters through numerous small openings and, due to the pressure difference across the openings, enters uniformly distributed into a chamber 64, which is formed by sheet metal sides 61 and by the warp beam 60. The chamber 64 is covered off by the relatively densely lying warp threads 7, through which the conditioned air must pass uniformly at low velocity and enter the atmosphere of the installation room. Such an arrangement has proved to be a quite economical solution to the conditioning of the warp threads. Due to the relatively great length of the free-lying warp threads 7, which are exposed to the conditioned air between the warp beam 60 and the weaving rotor 2, the acting time for the conditioning is sufficient even at higher insertion rates.

Naturally the details described here which are not influenced by the weaving rotor or the laying-in station can also be applied to weaving machines other than the series shed weaving machines.

What is claimed is:

1. A series shed weaving machine with a weaving rotor which is equipped with insertion and beat-up combs, the machine combs through warp threads with the insertion combs in the form of sheds at its periphery from a laying-in station up to a cloth edge while weft threads are fed into the sheds from a weft thread preparation, with the beat-up combs of the weaving rotor beating up the inserted weft threads against the edge of the formed cloth wherein the weaving rotor is covered by a cover forming a ring channel in the region of the combs from the laying-in station up to immediately ahead of the cloth edge in the direction of of rotor rotation; and in that suction nozzles are mounted along the cloth edge which suck out from the ring channel introduced air along with arising fly.

2. A series shed weaving machine in accordance with claim 1 wherein the ring channel has an average distance from the cover to a highest tips of the combs which is less than 25 mm.

3. A series shed weaving machine in accordance with claim 1 wherein the proportion of the nozzle cross-section of the suction nozzles per unit length increases in a weft insertion direction in order to avoid congestion.

4. A series shed weaving machine in accordance with claim 1 wherein a depression relative to atmospheric pressure is present at the inlet and outlet of the ring channel under the suction effect of the suction nozzles in order that less fly is lost to the exterior.

5. A series shed weaving machine in accordance with claim 1 wherein the suction nozzles are mounted in the cover and lead to a common suction tube extending along a beat-up edge.

6. A series shed weaving machine in accordance with claim 1 wherein the part of the cover which covers the sheds is executed as a cover, the cover is adapted to be removable and remountable with a guided movement by pivot arms.

7. A series shed weaving machine in accordance with claim 6 wherein the cover is adapted to be removable to such an extent that elements at the outer edge of the cloth being produced are accessible and can be designed to move outwardly.

8. A series shed weaving machine in accordance with claim 1 wherein the ring channel is extended at a weft-thread arrival side outside of the combs by a second ring-shaped channel which has a side wall to seal relative to the weaving rotor; and wherein an additional suction nozzle with its cross-section following the second ring-shaped channel is mounted at the side wall before the beat-up edge in a direction of rotation in the region of the warp thread ends in order to suck up fly and to better align the weft threads.

9. A series shed weaving machine in accordance with claim 8 wherein elements protruding into the ring-shaped channel, have outer contours streamlined in the direction of rotation in order to keep the accumulation of fly small.

10. A series shed weaving machine in accordance with claim 8 wherein the additional suction nozzle and a suction tube as well as further fly collection lines are led via a filter to a central suction fan.

11. A series shed weaving machine in accordance with claim 10 wherein air emerging from the central suction fan and cooling air emerging from motors and a control system are brought together at the machine in order to convey them out of an installation room.

12. A series shed weaving machine in accordance with claim 1 wherein further covers are placed around the weaving rotor from the cloth edge to the laying-in station in the direction of rotation and have a small distance from tips of the combs in order to avoid the accumulation of fly.

13. A series shed weaving machine in accordance with claim 10 wherein parts of the covers are executed as deformable aprons which can brush against the tips of the combs in the direction of rotation in the presence of low pressure.

14. A series shed weaving machine in accordance with claim 13 wherein the apron consists of a thick film, the abrasion of which effects a lubricating action on the combs during the laying-in and combing through of the sheds.

15. A series shed weaving machine in accordance with claim 1 further comprising an air conditioning channel that is adapted to be supplied with conditioned air and whose end toward the atmosphere is covered by the warp threads between a warp beam and the laying-in station in order to condition the warp threads with the air passing through.

* * * * *